US006604956B2

(12) United States Patent
Ruiz et al.

(10) Patent No.: US 6,604,956 B2
(45) Date of Patent: Aug. 12, 2003

(54) SELF-STRIPPING CONNECTING DEVICE FOR TWO ELECTRIC CABLES

(75) Inventors: Ariel Ruiz, Villeurbanne (FR); Arsène Schmidt, St Cyr au Mont d'or (FR)

(73) Assignee: Entrelec S.A., Lyons (FR)

( * ) Notice: Subject to any disclaimer, the term of this patent is extended or adjusted under 35 U.S.C. 154(b) by 12 days.

(21) Appl. No.: 09/937,343

(22) PCT Filed: Feb. 6, 2001

(86) PCT No.: PCT/FR01/00345

§ 371 (c)(1),
(2), (4) Date: Sep. 24, 2001

(87) PCT Pub. No.: WO01/57957

PCT Pub. Date: Aug. 9, 2001

(65) Prior Publication Data

US 2002/0155759 A1 Oct. 24, 2002

(30) Foreign Application Priority Data

Feb. 7, 2000 (FR) ..... 00/01499

(51) Int. Cl.[7] ..... H01R 4/24
(52) U.S. Cl. ..... 439/409; 439/402; 439/412

(58) Field of Search ..... 439/409–419, 439/428, 801, 806, 807, 812, 815, 790, 791, 397, 404, 402

(56) References Cited

U.S. PATENT DOCUMENTS 4,597,623 A * 7/1986 Krumreich ..... 439/411
5,203,716 A * 4/1993 Martucci et al. ..... 439/411

FOREIGN PATENT DOCUMENTS

EP 0 099 008 A2 1/1984
EP 0 519 196 A1 12/1992
GB 2 103 434 A 2/1983

* cited by examiner

*Primary Examiner*—Jean F. Duverne
(74) *Attorney, Agent, or Firm*—Oliff & Berridge, PLC

(57) ABSTRACT

The invention concerns a device with a conductive core (10*a*) and an insulating sheath (10*b*) comprising a stripping and retaining slot (18). It comprises: a second stripping and retaining slot (18) substantially parallel to the first and offset relative to the direction of the slots; a push-member (8) designed to receive two electric cables (10) and configured such that each cable should be located transversely opposite a stripping and retaining slot (18), and means (4) for producing a relative displacement between the push-member (8) and the stripping slots (18).

10 Claims, 4 Drawing Sheets

SELF-STRIPPING CONNECTING DEVICE FOR TWO ELECTRIC CABLES

Figure 1:
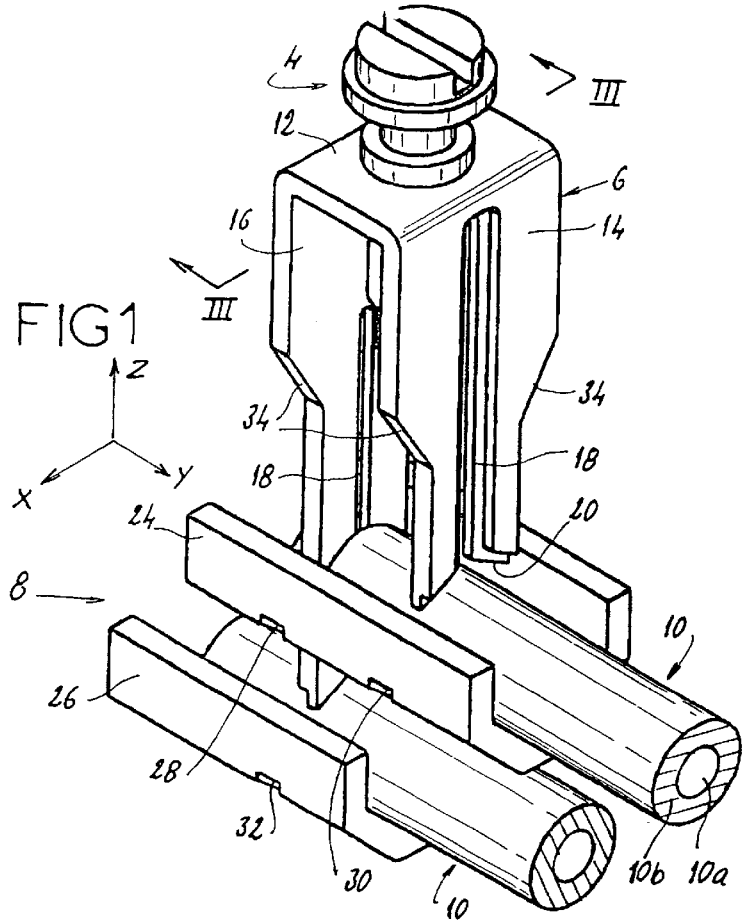

The present invention relates to an insulation-displacement connecting device for connecting two electric cables.

An insulation-displacement connecting device allows an electric cable to be connected to a conducting part without the need beforehand to strip one end of the electric cable. The insulation-displacement connecting device locally bares the cable, for example by cutting into the insulating sheath which lies around the conducting core, before making electrical contact between the conducting core thus locally bared and the conducting part.

Documents EP-0 247 360 or alternatively FR-2 723 474 disclose insulation-displacement connecting devices. An insulation-displacement connecting device comprising two insulation-displacement slots is disclosed by document FR-2 675 953. Here, the two holding and insulation-displacement slots are aligned and are intended for the connection of one self same electric wire.

The known insulation-displacement connecting devices allow an electric cable of predetermined diameter, or the predetermined diameter of which lies in a fairly restricted predetermined range of diameters, to be connected. Furthermore, when the known insulation-displacement connecting devices allow two electrical cables to be connected, these have both to be of the same diameter.

It is therefore an object of the present invention to provide an insulation-displacement connecting device that allows two cables of different diameters to be connected.

To this end, the device that the present invention proposes is an insulation-displacement connecting device for connecting at least two electric cables having a conducting core and an insulating sheath, the device comprising an insulation-displacement and retaining slot. Document EP-0 247 360 for example discloses such a device.

According to the invention, this device comprises:

- at least one other insulation-displacement and retaining slot (18) known as the second such slot, essentially parallel to the first and offset with respect to the direction of the slots,
- a pusher intended to accommodate two electric cables at least and shaped in such a way that each cable can lie transversely facing an insulation-displacement and retaining slot,
- means of connection between the slots and the pusher allowing a relative displacement of the slots and of the pusher and guiding this displacement, and
- means for bringing about the relative displacement of the pusher and of the insulation-displacement slots.

Thus, two insulation-displacement and retaining slots each allow one electric cable to be connected. The connecting of one cable is therefore not influenced by the connecting of the other cable. The connecting of two cables of different diameters may be envisioned.

In a first embodiment of a connecting device according to the invention, the two insulation-displacement and retaining slots are made in a blade bent into a U having two parallel branches of different lengths, each slot opening at the free end of each branch. The two insulation-displacement and retaining slots are therefore made in one and the same conducting part.

In this form of embodiment, the pusher comprises, for example, two profiled parts extending in the plane containing the two slots, transversely with respect to the slots, and openings are advantageously provided for the passage of each slot and of the corresponding edges through the profiled parts. In this case, the width of each opening is, for example, such that it allows the part carrying the corresponding slot to be guided and closes the edges of the slot together so that they press against the metal core of a connected cable. The material used for the blade may therefore be chosen essentially for its good conducting properties without paying too much attention to its elastic mechanical properties needed to ensure that the edges of the slot press firmly against the bared conducting metal core thereby ensuring good electrical contact.

Provision may be made for the slots to be moveable with respect to the pusher, but of course it is also possible to have a pusher which can move and slots which are fixed. Another solution which is more complicated to implement would be to have slots and a pusher all of which could move.

When the slots can move, a screw is, for example, provided for displacing the slots, this screw being engaged in a metal part connecting the two slots and incapable of translational movement with respect to an insulating casing.

The relative movement of the slots and the pusher is, for example, a translational movement or alternatively a pivoting movement.

When the relative movement of the slots and the pusher is a pivoting movement, provision may be made for the slots to be carried by parallel curved blades, for the pusher to be mounted so that it can pivot and to have two housings essentially transversal with respect to the slots, openings being provided for the passage of the blades carrying the slots.

A screwdriver blade may be intended to perform the pivoting movement of the pusher. A housing intended to accommodate the end of such a blade is then advantageously provided in the pusher.

The present invention also relates to a junction unit in which a connecting device as described hereinabove is placed.

In any event, the invention will be clearly understood with the aid of the description which follows, with reference to the attached schematic drawing which, by way of non-limiting examples, depicts two forms of embodiment of an insulation-displacement connecting device according to the invention.

Figure 2:
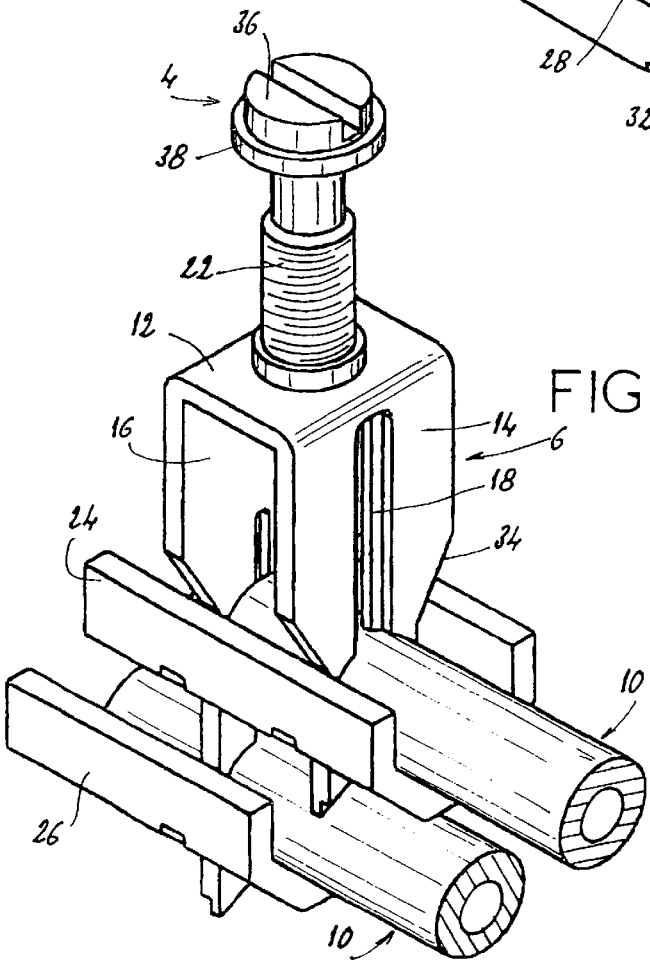
Figure 3:
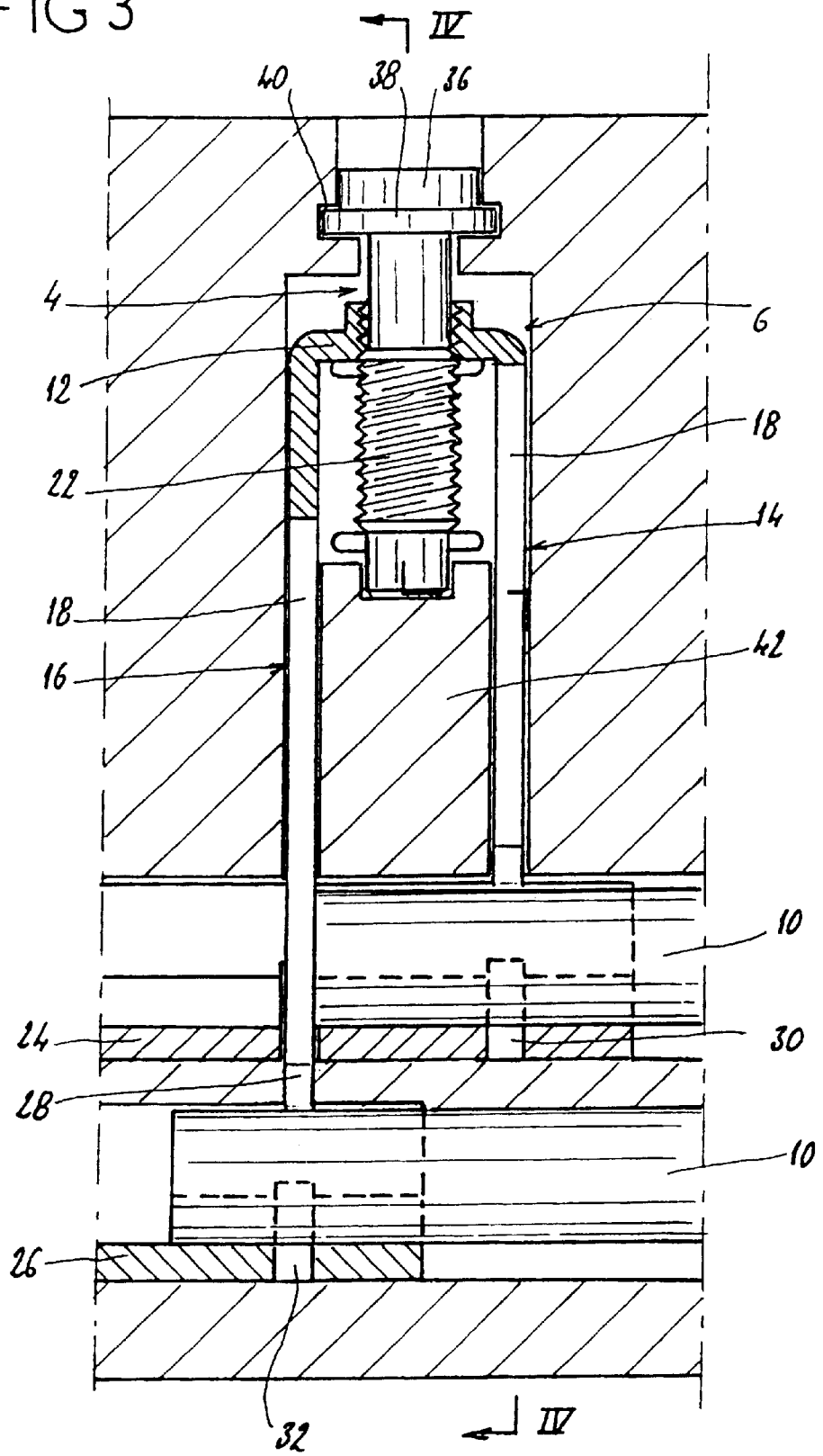
Figure 4:
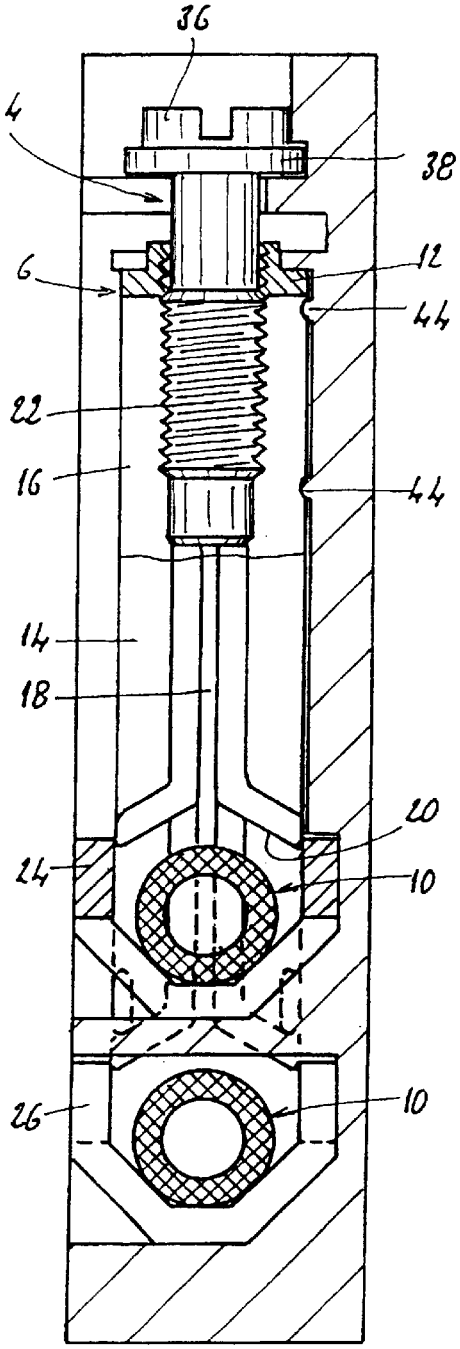
Figure 5:
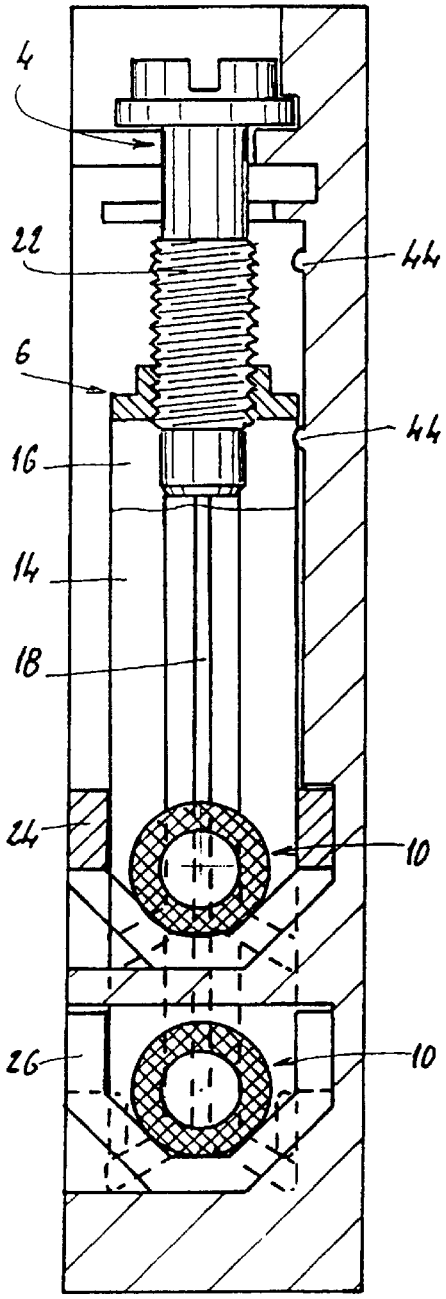
Figure 6:
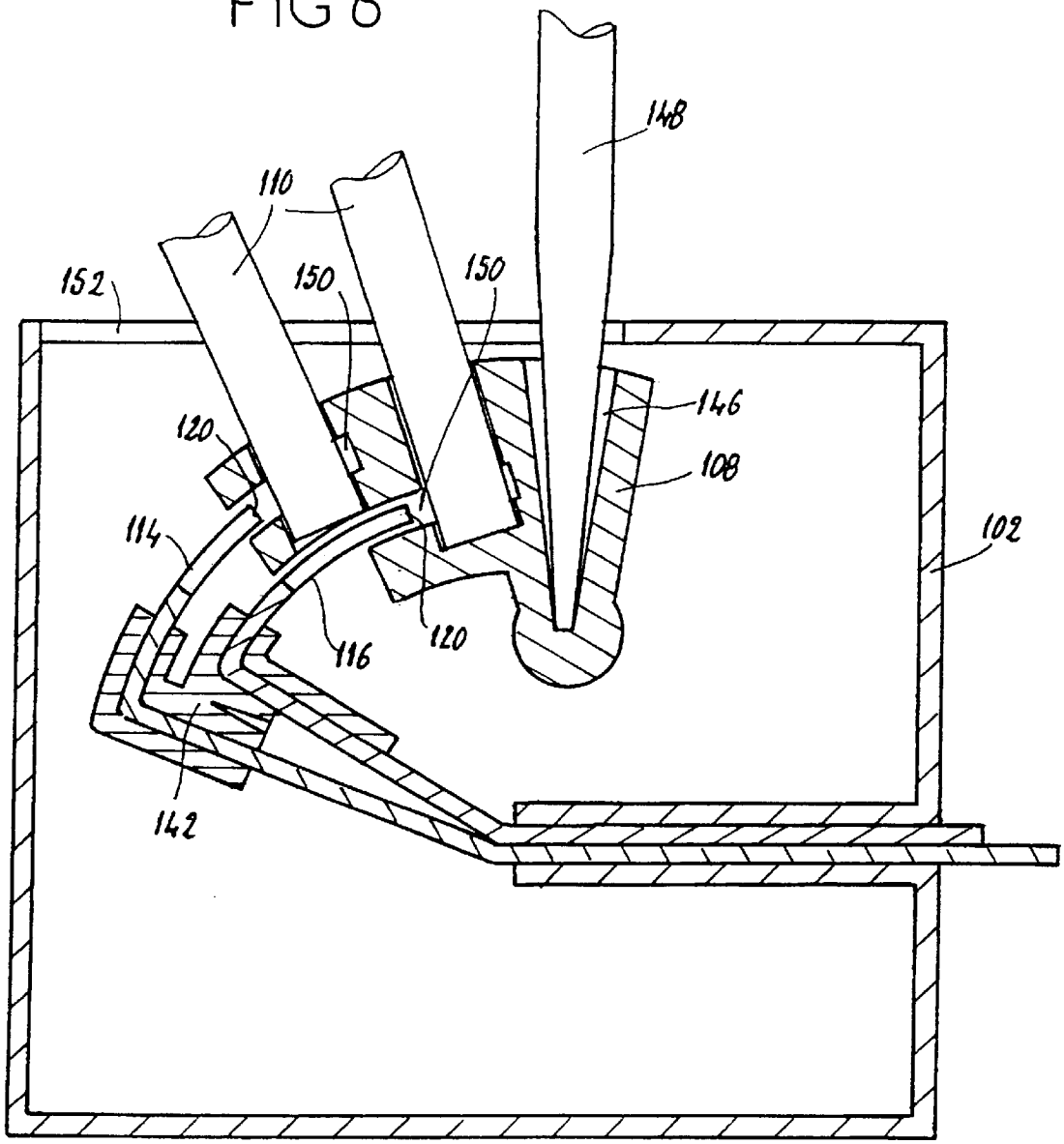

FIG. 1 is a perspective view showing the principle of a first form of embodiment, prior to the connecting of two electric cables, FIG. 2 is a view corresponding to FIG. 1, the cables having been connected, FIG. 3 is a view in section on the section line III—III of the device of FIG. 1, this device being placed in an insulating casing, FIG. 4 is a view in section on the section line IV—IV of FIG. 3, FIG. 5 is a view corresponding to the view of FIG. 4, the cables depicted in FIG. 4 being connected, and FIG. 6 is a view in longitudinal section of a second form of embodiment of a connecting device according to the invention.

FIGS. 1 and 2 are perspective views showing a connecting principle according to the invention, while FIGS. 3 to 5 show the device of FIGS. 1 and 2 in place in an insulating casing 2. FIGS. 1 and 2 show a screw 4, a metal blade 6 bent into a U, a pusher 8 and two cables 10, each cable having a conducting core 10*a* and an insulating sheath l0*b*.

The metal blade 6 has a base 12 to which two parallel branches 14 and 16 are attached. In the remainder of the description it will be considered that the base 12 of the blade 6 lies in a horizontal plane while the branches 14 and 16 extend in a vertical plane.

Each branch 14, 16 comprises an insulation-displacement and retaining slot 18 which in this instance is straight and parallel to the longitudinal axis of the corresponding branch 14, 16. Each slot 18 therefore extends vertically. The blade 6 is, for example, obtained from a flat blank by pressing, involving cutting-out, then folding, possibly carrying out localized thinning.

Each insulation-displacement and retaining slot 18 has, at one end, the end corresponding to the free end of the corresponding branch 14, 16, an insulation-displacement mouth 20. The latter is obtained by cutting the edges of the slot 18 symmetrically at an angle. This angled cut makes it possible to obtain a widened mouth, the edges of which form a cutting edge making it possible to cut into the sheath l0*b* of an electric cable 10 pushed into the mouth 20.

The blade 6 is made, for example, of copper or alternatively of a copper-containing alloy with a high copper content. Thus, when a cable 10 has been engaged in the slot 18 and its sheath 10*b* has been cut in the region of the mouth 20, the conducting core 10*a* of this cable is in electrical contact with the edges of the slot 18. The material of which the blade is made therefore allows excellent conduction of the current passing through the electric cable.

The branches 14 and 16 have different lengths. In the drawing, the branch 14 is the shorter one. The two slots 18 are essentially identical. These two slots are therefore offset in height and spaced apart by a distance of the order of a few millimeters, or even a few tens of millimeters. FIG. 1 shows an orthonormal frame of reference X, Y, Z, the Z-axis defining the vertical and the X- and Y-axes defining a horizontal plane. It is assumed that the cables 10 extend parallel to the Y direction. The insulation-displacement and retaining slots 18 are therefore offset with respect to one another in the direction of the Y-axis and also in the direction of the Z-axis. Thus, the insulation-displacement slots are arranged in a staircase or steps configuration.

The base 12 of the blade 6 has a tapping intended to collaborate with the threaded part 22 of the screw 4.

The pusher 8 has two profiled parts 24 and 26, the profiled part 24 being arranged above the profiled part 26.

The two profiled parts 24, 26 extend essentially along the Y-axis. These are open profiled parts, the open side of the profile facing upward, that is to say toward the blade 6.

The upper profiled part 24 is arranged, with respect to the blade 6, in such a way that the branch 16 passes through it but the branch 14 does not. An opening 28 is provided to allow for the passage of the branch 16. Likewise, on the profile 24 there is an opening 30 designed to allow the passage of the branch 14 and an opening 32 made in the profile 26 and intended to accommodate the branch 16.

The profiled parts 24 and 26 are thus in the form of a channel section extending horizontally, transversely to the branches 14 and 16 and acting as housings for the cables 10 that are to be connected. The two profiled parts 24, 26 are made, for example, of steel. They may be connected to one another or may be independent. In fact, provision is made for the blade 6 to be displaced with respect to the pusher 8. This displacement is in the Z direction, that is to say the direction given by the slots 18. If the blade 6 is displaced, the profiled parts 24 and 26 are, for example, independent of one another, whereas if the pusher 8 is displaced toward the blade 6, it is preferable to have two profiled parts which are joined together.

In order to allow two cables 10 to be connected, a cable 10 that is to be connected is introduced into each housing formed by the profiled parts 24 and 26. The cable 10 placed in the upper profiled part 24 is pushed in the direction of the Y-axis until it comes into abutment against the branch 16. The cable arranged in the lower housing of the profiled part 26 is associated with a limit stop which has not been depicted in the drawing. This limit stop is, for example, made in the insulated casing 2.

In order to displace the blade 6 and cause the slots 18 to drop down toward the cables 10, the screw 4 is turned. Each cable then comes into contact with a mouth 20 which cuts the insulating sheath. l0*b* of the corresponding cable. By continuing to turn the screw 4, each cable 10 is bared and its conducting core 10*a* is introduced between the parallel edges of the slot 18. Electrical contact between the conducting core 10*a* and the blade 6 is thus made.

To guarantee good electrical contact between the edges of the slot of the branch 14 and the upper cable 10 and the edges of the slot of the branch 16 and the lower electric cable, the openings 30 and 32 respectively intended to accommodate these branches 14 and 16 respectively are sized in such a way that the edges of the slots 18 are each time pushed closer together toward the conducting core 10*a* of the corresponding cable in the case of fat conductors. In the case of small conductors, the elasticity of the branches 14 and 16 is enough to ensure contact. Thus, the branches backed up by the openings tolerate a wider range for connection.

FIGS. 3 to 5 show the device of FIGS. 1 to 2 in place in the insulating casing 2. FIG. 3 shows how the insulating casing holds the screw 4 and the blade 6 in position.

The screw 4 has a head 36, at the periphery of which there is an annular rib 38. The latter is placed in a groove 40 of a size and shape tailored to accommodate it. Thus, when a screwdriver acts on the screw head 36 to turn the screw 4, the screw is not displaced in terms of translation in such a way as to cause the translational movement of the blade 6. A plug of synthetic material 42 is provided between the branches 14 and 16 so as to ensure perfect guidance of these branches in their translational movement. Any buckling phenomenon can thus be avoided when a cable is being bared and electrically connected. The plug 42 can also act as a rest for the opposite end of the screw 4 to its head 36.

In FIGS. 4 and 5, the blade 6 is depicted in the high position and in the low position. Limit stops 44 are provided in the casing to index the high position and the low position of the blade 6.

In order to extract a conductor 10 connected in a device such as the one described hereinabove, the screw 4 is unscrewed. Thus, the blade 6 rises back up, taking the conducting cables 10 with it. The upper cable 10 comes into abutment against the insulation of the casing 2 (FIG. 3) and the lower cable 10 comes into abutment against the profiled part 24. By continuing to unscrew, the blade 6 continues to move up and the cables 10 are bared.

FIG. 6 shows an alternative form of embodiment of a connecting device according to the invention. In that figure, parts which have a function similar to that of parts in FIGS. 1 to 5 readopt the same references as those parts, but increased by the number 100.

In this form of embodiment we again see a pusher 108, two cables 110, two branches 114 and 116, in each of which a slot, not depicted, is made, and which end in an insulation-displacement mouth 120.

The branches 114 and 116 are the curved and bent-over ends of a conducting metal blade. These branches 114 and 116 have a radius of curvature and run parallel to one another. The center of curvature of these two branches 114 and 116 is practically the same. These branches are offset, on the one hand radially and, on the other hand, angularly. The blades 114 and 116 are held in place in a casing 102 by a plug 142 integral with this casing 102.

The pusher 108 is mounted so that it can pivot about a point essentially corresponding to the center of curvature of branches 114 and 126. Guide grooves, not depicted, are made in the interior walls of the casing 102 so that the pusher 108 can be appropriately guided.

This pusher has three housings extending essentially radially with respect to the center of pivoting. Two housings are intended for the cables 110 and a third housing 146 is intended to accommodate the end of a screwdriver blade 148. The pusher 108 also has openings 150 intended for the passage of the blades 114 and 116. In the position depicted in FIG. 6, prior to connection of the two cables 110, the mouths 120 of the blades 114 and 116 are at the entry to the openings 150. These openings 150 are essentially perpendicular to the housing intended to accommodate the cables 110. They have a curved shape, their center of curvature being essentially the same center of curvature as that of the branches 114 and 116.

To connect two cables 110, these are introduced into the housings provided for that purpose in the pusher 108. A first cable 110 comes into abutment against the branch 116 while the housing intended for the other cable 110 is blind. The end of the screwdriver blade 148 is then introduced into the housing 146. An opening 152 made in the casing 102 allows the cables 110 and the screwdriver blade 148 to be introduced into their respective housings.

By then using the screwdriver blade 148 to pivot the pusher 108 toward the branches 114 and 116, the cables 110 are therefore bared and held in the insulation-displacement and retaining slots of these blades. The two cables 110 are thus connected.

In order to guarantee good electrical contact between the branches 114 and 116 and the conducting core of the cables 110, provision may be made for the width of the openings 150 to be such that in the connected position the edges of the insulation-displacement and retaining slots are closed together onto the conducting core of the cable 110. The material used for the branches 114 and 116 can then be a material which is a very good conductor without in any way having to have excellent mechanical properties from the elasticity standpoint.

In this form of embodiment, by comparison with the one shown in FIGS. 1 to 5, there is a moving pusher and immobile insulation-displacement and retaining slots. Furthermore, the relative movement of the pusher and the slots is not a translational movement but a rotational movement. In this instance, the two insulation-displacement and retaining slots are not made in the one same blade but in two separate blades which are in electrical contact with one another.

The forms of embodiment described hereinabove and depicted in the drawing show connecting devices which allow excellent connection of two cables, even if these are of different diameters. What happens is that given that the two cables are connected on separate insulation-displacement and retaining slots, the larger-diameter cable does not prevent the connecting of a smaller-diameter cable. The two insulation-displacement and retaining slots of one and the same connecting device according to the invention can both be designed for connecting cables the diameters of which are in one and the same predetermined range. However, it is possible to envision one insulation-displacement and retaining slot intended to accommodate large-diameter cables, and one insulation-displacement and retaining slot intended for cables of smaller diameters. In any event, the connecting of one electric cable has no influence on the connecting of the other electric cable.

As goes without saying, the invention is not restricted to the forms of embodiment described hereinabove by way of nonlimiting examples; on the contrary, it encompasses all alternative forms of embodiment thereof which fall within the scope of the claims hereinafter.

Thus, the exemplary embodiments described show either a fixed pusher with slots which can be displaced in translation or fixed slots with a moving pusher that can be displaced in rotation. Of course it would be possible to have a moving pusher that is displaced in translation or moving blades that are displaced in rotation.

Other means for achieving the displacement of the pusher or of the slots may be envisioned. For example, it is possible to conceive of a blade or of a pusher protruding from the casing and intended to be displaced by direct action from the finger of an operator.

Likewise, in the examples described hereinabove, the arrangements according to the invention allow two cables to be connected. However, in accordance with the invention, a connecting device could allow the connecting of three cables or more.

To this end, the connecting device comprises as many insulation-displacement slots as there are cables to be connected, the insulation-displacement slots preferably all being aligned in one and the same plane and offset in two directions. Thus, the slots are arranged in a staircase or steps configuration. In addition, the device comprises as many accommodating housings as there are cables to be connected. Each housing is then designed for the engagement of the cable it accommodates in the corresponding insulation-displacement slot. It is to be noted that, like the insulation-displacement slots, housings are also arranged in a staircase or steps configuration.

What is claimed is:

1. An insulation-displacement connecting device for connecting at least two electric cables (10; 110) having a conducting core (10*a*) and an insulating sheath (10*b*), the device comprising an insulation-displacement and retaining slot (18), further comprising:

at least one other insulation-displacement and retaining slot (18) known as the second such slot, essentially parallel to the first such slot and offset with respect to a separation direction of the slots;

a pusher (8; 108) intended to accommodate at least two electric cables (10; 110) and shaped so that each cable lies transversely facing an insulation-displacement and retaining slot (18);

means (2, 102) of connection between the slots (18) and the pusher (8, 108) allowing a relative displacement of the slots and of the pusher and guiding the relative displacement; and means (4; 108, 146) for bringing about the relative displacement of the pusher (8; 108) and of the insulation-displacement slots (18), wherein the two insulation-displacement and retaining slots (18) are made in a blade (6) bent into a U having two parallel branches (14, 16) of different lengths, each slot (18) opening at the free end of each branch, the pusher (8) comprises two profiled parts (24; 26) extending transversely with respect to the slots and along the separation direction of the slots (18), and openings (30, 32) are provided for the passage of each slot and corresponding edges of the two parallel branches through the profiled parts.

2. The connecting device as claimed in claim 1, characterized in that a width of each opening (30, 32) is such that the opening allows the part carrying the corresponding slot to be guided, and the opening closes the edges of the slot together so that they press against the metal core (10*a*) of a connected cable.

3. The connecting device as claimed in claim 2, characterized in that the slots (18) can move with respect to the pusher (8).

4. The connecting device as claimed in claim 3, characterized in that the slots (18) can move with respect to the pusher (8).

5. The connecting device as claimed in claim 5, characterized in that a screw (4) is provided for displacing the slots (18), this screw being engaged in a metal part (12) connecting the two slots and incapable of translational movement with respect to an insulating casing (2).

6. The connecting device as claimed in claim 1, characterized in that the relative movement of the slots and of the pusher (108) is a pivoting movement.

7. The connecting device as claimed in claim 7, characterized in that the slots are carried by parallel curved blades (114; 116), in that the pusher (108) is mounted so that it can pivot and has two housings which are essentially transversal with respect to the slots, openings (150) being provided for the passage of the blades (114; 116) carrying the slots.

8. The connecting device as claimed in claim 7, characterized in that a housing (146) intended to accommodate the end of a screwdriver blade (148) is provided in the pusher (108).

9. The connecting device as claimed in claim 7, characterized in that a housing (146) intended to accommodate the end of a screwdriver blade (148) is provided in the pusher (108).

10. A junction unit, comprising at least one connecting device for connecting at least two electric cables (10; 110) having a conducting core (10*a*) and an insulating sheath (10*b*), the device comprising an insulation-displacement and retaining slot (18) and further comprising:

at least one other insulation-displacement and retaining slot (18) known as the second such slot, essentially parallel to the first such slot and offset with respect to a separation direction of the slots;

a pusher (8; 108) intended to accommodate two electric cables (10; 110) at least and shaped in such away that each cable lies transversely facing an insulation-displacement and retaining slot (18);

means (2, 102) of connection between the slots (18) and the pusher (8, 108) allowing a relative displacement of the slots and of the pusher and guiding this displacement; and means (4; 108, 146) for bringing about the relative displacement of the pusher (8; 108) and of the insulation-displacement slots (18), wherein the two insulation-displacement and retaining slots (18) are made in a blade (6) bent into a U having two parallel branches (14, 16) of different lengths, each slot (18) opening at the free end of each branch, the pusher (8) comprises two profiled parts (24; 26) extending transversely with respect to the slots and along the separation direction of the slots (18), and openings (30, 32) are provided for the passage of each slot and corresponding edges of the two parallel branches through the profiled parts.

* * * * *